US005960681A

United States Patent [19]

Anderson et al.

[11] Patent Number: 5,960,681

[45] Date of Patent: Oct. 5, 1999

[54] SOCKET DRIVER WITH RETAINING PROTUBERANCES AND METHOD OF MANUFACTURING SAME

[76] Inventors: Wayne Anderson, 65 Grove St., Northport, N.Y. 11768; Paolo Cassutti, 8 N. Creek Rd., Northport, N.Y. 11729; Warren R. Anderson, 7 Worcester Dr., Northport, N.Y. 11768

[21] Appl. No.: 08/890,694

[22] Filed: Jul. 11, 1997

Related U.S. Application Data

[60] Provisional application No. 60/023,119, Jul. 31, 1996.

[51] Int. Cl.[6] ..... B25B 13/02; B25B 13/06; B25B 13/00

[52] U.S. Cl. ..... 81/125; 81/121.1; 81/124.6

[58] Field of Search ..... 81/121.1, 125, 81/124.6, 186

[56] References Cited

U.S. PATENT DOCUMENTS

| | | | |
|---|---|---|---|
| 994,804 | 6/1911 | Wahlstrom . | |
| 2,010,616 | 8/1935 | Walsh . | |
| 2,523,041 | 9/1950 | McKenzie . | |
| 2,718,806 | 9/1955 | Clark . | |
| 2,851,295 | 9/1958 | Chaffee . | |
| 3,253,626 | 5/1966 | Stillwagon et al. . | |
| 3,935,762 | 2/1976 | Tudisco . | |
| 4,096,896 | 6/1978 | Engel . | |
| 4,126,063 | 11/1978 | Palmer | 81/121 |
| 4,328,720 | 5/1982 | Shiel . | |
| 4,469,727 | 9/1984 | Gray | 72/75 |
| 4,535,658 | 8/1985 | Molinari . | |
| 5,295,423 | 3/1994 | Mikic . | |
| 5,309,798 | 5/1994 | Markwart et al. . | |
| 5,485,769 | 1/1996 | Olson et al. . | |
| 5,542,320 | 8/1996 | Vasichek et al. . | |
| 5,682,801 | 11/1997 | Waechter | 81/121.1 |

FOREIGN PATENT DOCUMENTS

| | | |
|---|---|---|
| 192062 | 10/1992 | Taiwan . |

*Primary Examiner*—David A. Scherbel
*Assistant Examiner*—Philip J. Hoffmann
*Attorney, Agent, or Firm*—Lackenbach Siegel Marzullo Aronson & Greenspan

[57] ABSTRACT

A socket driver, and method of forming the same, is described in which longitudinal protuberances are provided on successive surfaces of the hexagonal cavity for receiving a bit driver. The protuberances create an interference fit with the driven end of the bit driver, the protuberances being so dimensioned that forceful insertion of the bit driver into the hexagonal cavity at least partially deflects the walls portions on which protuberances are formed to thereby slightly deflect the same. The resulting restoring forces create a spring action which semi-permanently secures the bit driver received within the socket driver.

10 Claims, 4 Drawing Sheets

A
50
52

50
52

50
20
54

50
20
54

20
24
56

50
24
56

20
24
58

50
24
58

20
24
60

50
24
60

SOCKET DRIVER WITH RETAINING PROTUBERANCES AND METHOD OF MANUFACTURING SAME

This application claims benefits of provisional application 60/023,119 filed Jul. 31, 1996.

BACKGROUND OF THE INVENTION

1. Field of the Invention

The present invention generally relates to socket wrench sets, and more particularly, to socket drivers with tool bit retaining protuberances for retaining the driven members in the drive sockets.

2. Description of Prior Art

Typically, it is important to retain driving and driven members in coupling engagement with each other during use. While it is also important to be able to selectively separate these members from each other, such as for interchanging or replacing driven members to suit a particular application, it is frequently desirable to semi-permanently attach the driven members, such as bit drivers, to the driving members, such as socket drivers. In those instances, while it is desirable to remove the driven members under certain circumstances, the intention is to maintain the driving and driven members in coupling engagement with each other during normal use. One common approach for coupling a drive bit to a drive socket, for example, is the use of a coupling pin which extends diametrically through transverse holes through the engaged members. However, this approach has the disadvantage that it requires separate additional parts. Also, the bit and drive socket must have the transverse holes therein perfectly aligned with each other and accurately sized to securely receive the pin. Otherwise, the pin may become loose and fall out or may be sheared in use. This approach is relatively costly to manufacture.

Another common retention technique utilizes a spring-biased ball in the bit which is engagable with a complimentary recess or groove in the socket. This, again, involves a costly construction requiring the assembly of multiple parts.

In addition to the added manufacturing costs with the aforementioned techniques, engagement and disengagement of the bits and the sockets is relatively cumbersome and time consuming, requiring the mounting and demounting of a set screw or roll pin, each time the bit is changed. In fact, it is frequently so cumbersome to change set screws or roll pins that normally a user will purchase a separate socket for each bit to obviate the need for bit changing. The use of a friction ring for bit detention simplifies the changing but does not provide a very secure retention.

Clearly, the general use of one or more elements on at least one of the mating flat surfaces of a socket driver and tool bit for preventing inadvertent separation between the two during use is well known in the art. The use of a ball and spring arrangement has been commonly used for this purpose. Examples of patents which show this approach include U.S. Pat. Nos. 994,804 to Wahlstrom; 2,718,806 to Clark; and 5,309,798 to Markwart et al. In a number of cases, a spring element is used to urge a member, such as a stud, against a groove in the shank of a screwdriver bit, as illustrated in U.S. Pat. No. 2,010,616 to Walsh. In U.S. Pat. No. 2,523,041 to McKenzie, a screwdriver bit is provided with a protuberance on the shank of the screwdriver bit for engagement with interfering elements within the recess of the receiving cavity.

The problem which those in the art have sought to overcome is succinctly stated in column 1, lines 21–29 of U.S. Pat. No. 2,851,295 to Chaffee, where a ball and socket arrangement is disclosed.

A number of patents disclose the use of "O" rings intended to engage with recesses or regions of a tool bit. This is illustrated in U.S. Pat. Nos. 3,253,626 to Stillwagon et al., and 3,935,762 to Tudisco (see also U.S. Pat. No. 4,096,896 to Engel). The use of "O" rings and appropriate recesses in a bit driver are also illustrated in U.S. Pat. Nos. 4,328,720 to Shiel and 4,535,658 to Molinari.

In U.S. Pat. No. 5,295,423, a bit with frictional retention in the drive socket is illustrated in which appropriate recesses are provided in the flat surfaces of the bit itself. These are typically provided on opposing surfaces of the hexagonal bit configuration. The recesses cause the metal to flow outwardly and produce projections which extend above or beyond the flat surfaces of the bit. These projections fictionally engage the flat surfaces of the tool socket drivers. In U.S. Pat. No. 5,485,769 to Olson et al., FIG. 7 illustrates an outwardly projecting ear from the end surface of the bit.

SUMMARY OF THE INVENTION

It is an object of the present invention to provide an improved socket driver with driver bit retaining means which does not have the disadvantages inherent in prior art socket drivers.

It is another object of the present invention to provide a socket driver which includes retaining protuberances for semi-permanently retaining driver bits.

It is still another object of the present invention to provide a socket driver of the type above suggested which is simple in construction and economical to manufacture.

It is yet another object of the present invention to provide a socket driver with retaining protuberances of the type suggested by the previous objects which is effective in providing a simple bit driver retaining construction which does not involve additional parts, such as set screws or roll pins but which, nevertheless, can be used a plurality of times for inter-changing or replacing bit drivers within the same socket driver.

The above objects, as well as others which will become apparent hereinafter, are achievable in accordance with the present invention with a socket driver which comprises a body having a generally circular cylindrical wall defining an axis and having opposing axial ends. Coupling means is provided at one axial end for coupling said body to a mechanical drive during use, the other axial end of the body having a generally cylindrical cavity co-axially aligned with said body axis and defining an interior surface of said cylindrical wall. Said interior surface is formed of a plurality of substantially flat surfaces parallel to said axis and forming a receiving space of substantially uniform hexagonal cross section, said substantially cylindrical cavity being dimensioned to receive the shank of the bit driver with a conventional clearance fit. Retaining protuberance means is provided on alternate ones of said flat surfaces projecting into said cavity to establish an interference fit when the bit driver shank is inserted into the cavity. Said cylindrical wall and protuberance means having dimensions and formed of a material to provide, upon forceful insertion of a bit driver shank, sufficient outward deflection to create internal restoring forces sufficient to maintain a degree of retention on the driven bit driver within the socket driver.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which.

DESCRIPTION OF THE PREFERRED EMBODIMENT

Figure 1:
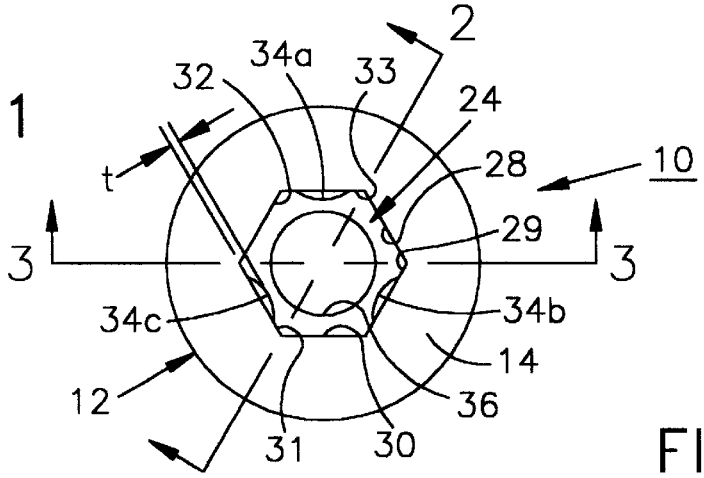
FIG. 1 is a top plan view of a socket driver in accordance with the present invention.
Figure 2:
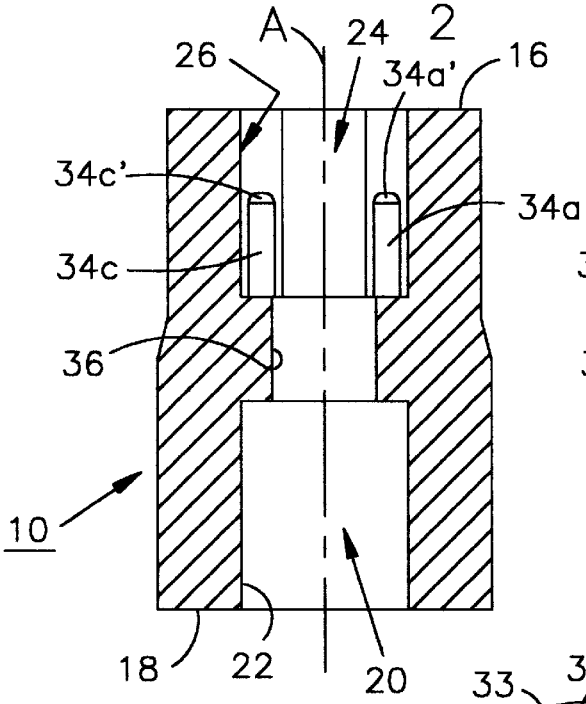
FIG. 2 is a cross sectional view of the socket driver shown in FIG. 1, taken along line 2—2.
Figure 3:
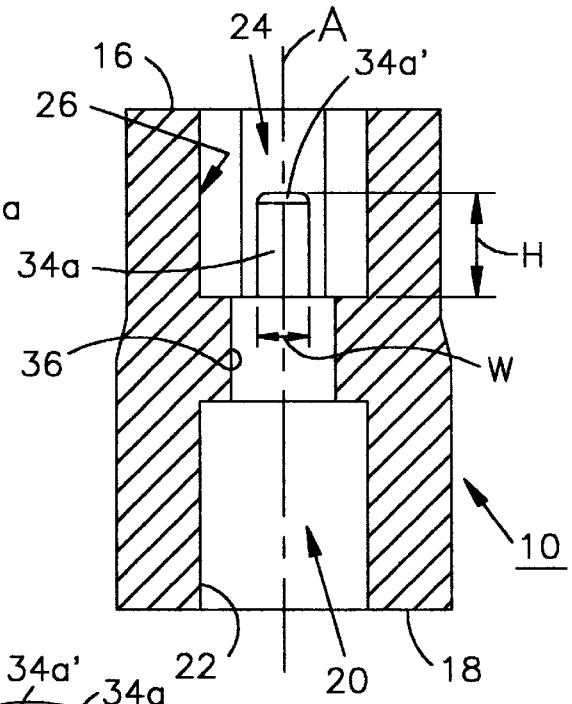
FIG. 3 is similar to FIG. 2 but taken along line 3—3 of FIG. 1.

Referring now specifically to the drawings, in which identical or similar parts will be designated by the same reference numerals throughout, and first referring to FIGS. 1–4, a socket driver in accordance with the present invention is generally designated by the reference numeral 10. In most respects, the socket driver 10 is similar or identical to conventional socket drivers used with socket wrench sets.

As will become evident from the description that follows, the socket drivers of the present invention can be identical to commercially sold socket drivers, with the exception of the provision of bit driver retaining means to be described. Thus, the socket driver 10 includes a body 12 having a generally circular cylindrical wall 14 which defines an axis of symmetry A and has opposing open axial ends 16, 18. Suitable coupling means is provided, at one axial end 18 for coupling the body 12 to a mechanical drive (not shown) during normal use. Such coupling means, is conventionally a generally square cavity 20 having a uniform cross section along the axis A formed of four mutually orthogonal rectangular flat surfaces 22, the cavity 20 being dimensioned to receive a correspondingly shaped driving end of a ratchet or extension member for a ratchet. The distances between opposing parallel flat surfaces 22 are typically ⅜, ¼ or ½ inch, which are industry standard sizes.

At the axial end 16, the body 12 is provided with a generally cylindrical cavity 24 which is likewise symmetrically arranged about the axis A and defines an interior surface 26 of the cylindrical wall 14. The interior surface 26 is formed of a plurality of substantially flat surfaces 28–33, each of which is parallel to the axis A and together form a receiving space of substantially uniform hexagonal cross section. The cylindrical cavity 24, as aforementioned, is conventional in connection with socket drivers and is dimensioned to receive a bit driver, as to be more fully discussed in connection with FIGS. 5 and 6.

An important feature of the present invention is the provision of retaining protuberance means on selected ones of the flat surfaces 28–33 which project into the hexagonal cavity 24 to establish an interference fit when the bit driver shank is inserted into the cavity. As best shown in FIGS. 1–4, the protuberance means 34*a*–34*c* are in the form of inwardly projecting bosses or projections which are generally flat in relation to the dimensions of the flat surfaces on which they are provided. The protuberances have a thickness "t" (FIG. 1), a height H and width W (FIG. 3) which are selected to permit insertion of a bit driver into the cavity 24 while providing sufficiently large retaining forces on the bit driver to render the attachment or coupling therebetween semi-permanent. Of these dimensions of the protuberances, the thickness t is probably the most critical, for reasons to be described particularly in relation to FIG. 6.

As is also conventional with socket drivers of the type being described, there is advantageously provided a through hole 36 which is generally co-axial with the axis A and joins the cylindrical cavities 20 and 24 as shown.

As will also be note from FIGS. 1–4, an important feature of the invention is that the protuberances 24*a*–34*c* are arranged on alternate or successive ones of the flat surfaces 28–33, so that diametrically opposing surfaces always include one such surface which is provided with a protuberance and the opposing surface is without a protuberance. Thus, for example, the flat surface 28 is not provided with a protuberance, while the opposing surface 31 is provided with protuberance 34*c*. This is also evident from FIGS. 2–4.

Figure 4:
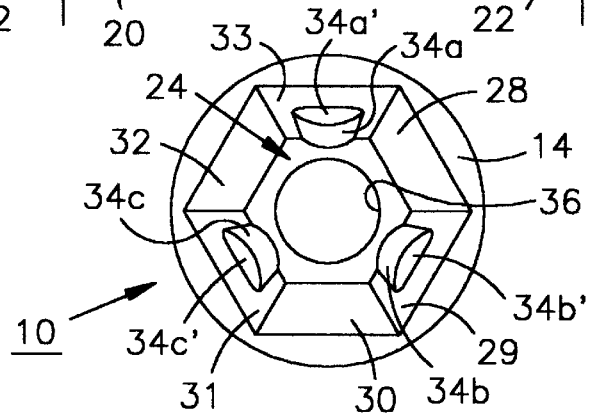
FIG. 4 is a top perspective view of the socket driver shown in FIG. 1.

Referring to FIG. 4, each of the protuberances 34*a*–34*c* is provided with an inclined surface which serves as a wedge to facilitate insertion of a bit driver. Thus, each of the protuberances 34*a*–34*c* include inclined surfaces 34*a*'–34*c*', 34*a*' also being indicated in greater detail in FIGS. 3 and 5.

Figure 5:
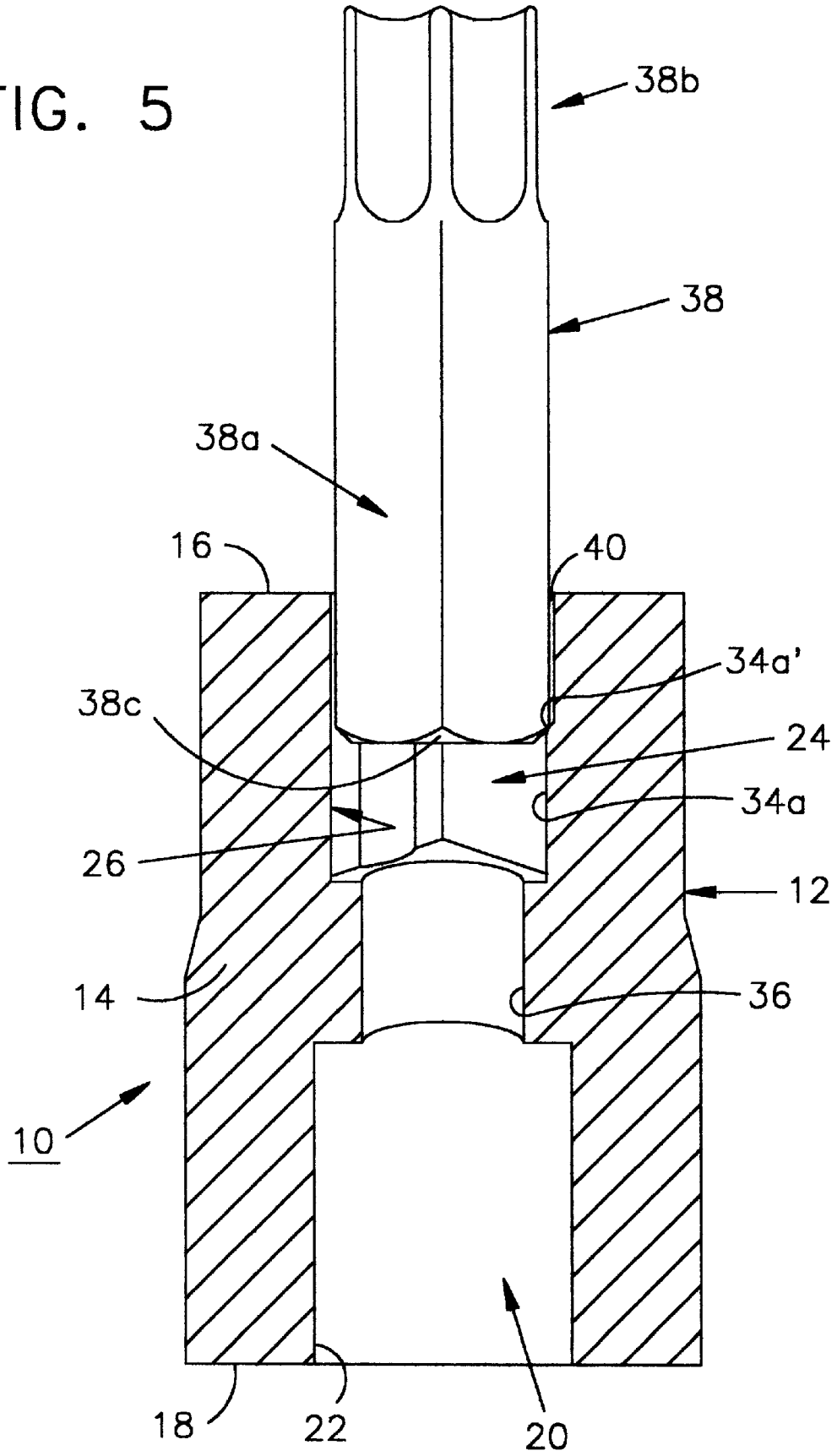
FIG. 5 is a cross sectional view of a socket driver in accordance with the present invention similar to the drivers shown in FIGS. 1–4, and showing a bit driver in the process of being inserted into the socket driver for semi-permanent mating therewith.

Referring to FIG. 5, a bit driver 38 is illustrated which has a shank or driven end 38*a* and a free driving end 38*b* which can assume any one of a number of different configurations, including a screwdriver blade, Phillips screwdriver termination, Torx, etc. A driver bit is formed of a generally uniform diameter cross section hexagonal shank which has conventional exterior dimensions so that it can be received within the hexagonal cavity 24 with a clearance fit. For purposes of the present invention a clearance fit will be defined as a fit having limits of size so prescribed that a clearance always results when mating parts are assembled. The lower end of the driven end 38*a* is provided with a chamfered or rounded edge 38*c* about the periphery of the end. When the driver bit 38 is initially introduced into the cavity 24 the clearance fit may result in some clearance or space, such as at 40. However, as soon as the driven end 30*a* encounters the protuberances 34*a*–34*c*, the chamfered or rounded edge 38*c* initially engages the inclined or tapered surfaces 34*a*'–34*c*', the two inclined mating surfaces serving as wedges and enabling the driven end 38*a* to be forced into the cavity 24. The thicknesses t of the protuberances is selected to provide an interference fit with the driven end 38*a* so that substantial force must be applied to the bit driver 38 to force the driven end 38*a* fully into the cavity 24. For purposes of this application, an interference fit will be defined as one having limits of size so prescribed that an interference always results when mating parts are assembled. The definitions of clearance fit and interference fit are consistent with the American Standard B 4.1-1955 (Preferred limits and fits for cylindrical parts). Once fully inserted into the socket driver 10, the bit driver 38 can be removed by inserting a suitable tool through the cavity 20 and the through hole 36 for the purpose of impacting the bit driver 38 and overcoming the retaining forces due to the interference fit as aforementioned.

Figure 6:
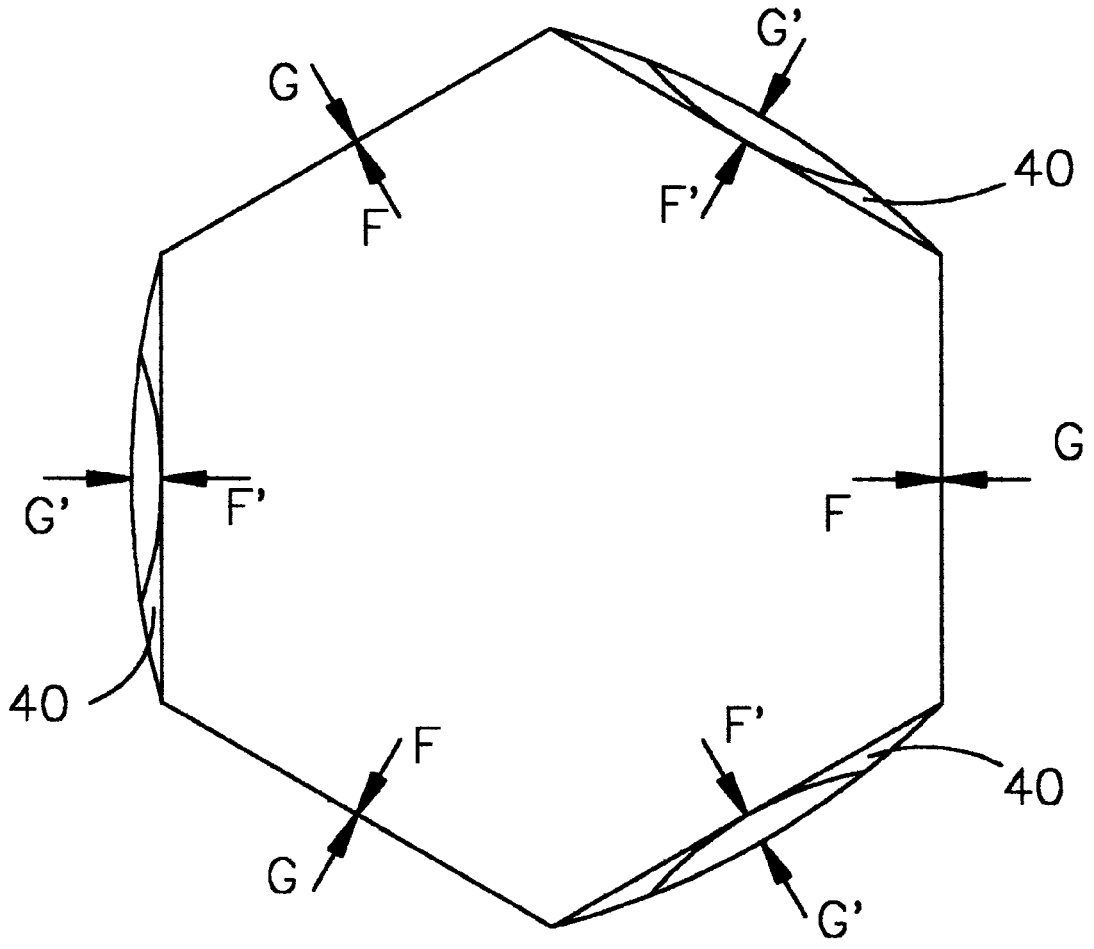
FIG. 6 is a diagrammatic representation of the interior walls or surfaces of the hexagonal bit driver receiving cavity, and the exterior walls of the mating flat surfaces of a bit driver, indicating the mechanical forces created when the bit driver is inserted into the socket driver as well as the retaining restoring forces for semi-permanently retaining the bit driver within the socket driver.

Referring to FIG. 6, the theory of operation of the socket driver, in accordance with the present invention, will be described. As will be evident from FIG. 5, the forceful insertion of the bit driver 38 into the cavity 24, an interference fit with the protuberances 34*a*–34*c* applies significant forces A which are directed radially outwardly and which act on the interior surfaces 28–33 of the wall 12. The forces A are particularly great where the driven end abuts against the protuberances in pressed fit relationship. These forces are referenced A' and are generally sufficiently great that they deflect those portions of the cylindrical wall 12 in the regions proximate to the protuberance to cause outward deflections of those surfaces 29, 31 and 33 on which the protuberances are formed. In response, the cylindrical wall of the driver responds by creating forces B which are radially inwardly directed to oppose the respective forces created by the driven end 38*a*. Correspondingly, the forces B' are greater than the forces B and generally correspond to the forces A'. The effect of such construction is that the forces B' urge the driven end 38*a* against the diametrically opposing surfaces to eliminate any clearances 40 that may have been created due to the clearance fit dimensions. At the same time, however, because of the significant forces involved, and the deflection of the walls on which the protuberances are formed, the deflected walls provide a spring action and, due to the restoring forces, securely lock the opposing surfaces of the driven end 38*a* between a protuberance and an opposing surface of the hexagonal cavity 24. It will be clear that the degree of retention will be a function of both the thickness t, the width W and the height H of the protuberances. Thickness t determines the degree of deflection of the surfaces on which the protuberances are mounted. However, the heightened width of the protuberance also determines the axial region of the surfaces that are actually so deflected and, of course, the height and the width also determine the surface area of contact between the protuberance and a mating surface of the driven end 38*a*. Once the retaining or restoring forces are determined, the total retaining forces will clearly be a function of the surface area of contact between the surfaces of the driven end 38*a* and the protuberances. It will be well within the skill of one in the art to select the dimension of the protuberances to provide a desired amount of retaining force on the bit driver 38.

Figures 7, 8, 9, 10, 11, 12, 13, 14, 15, 16:
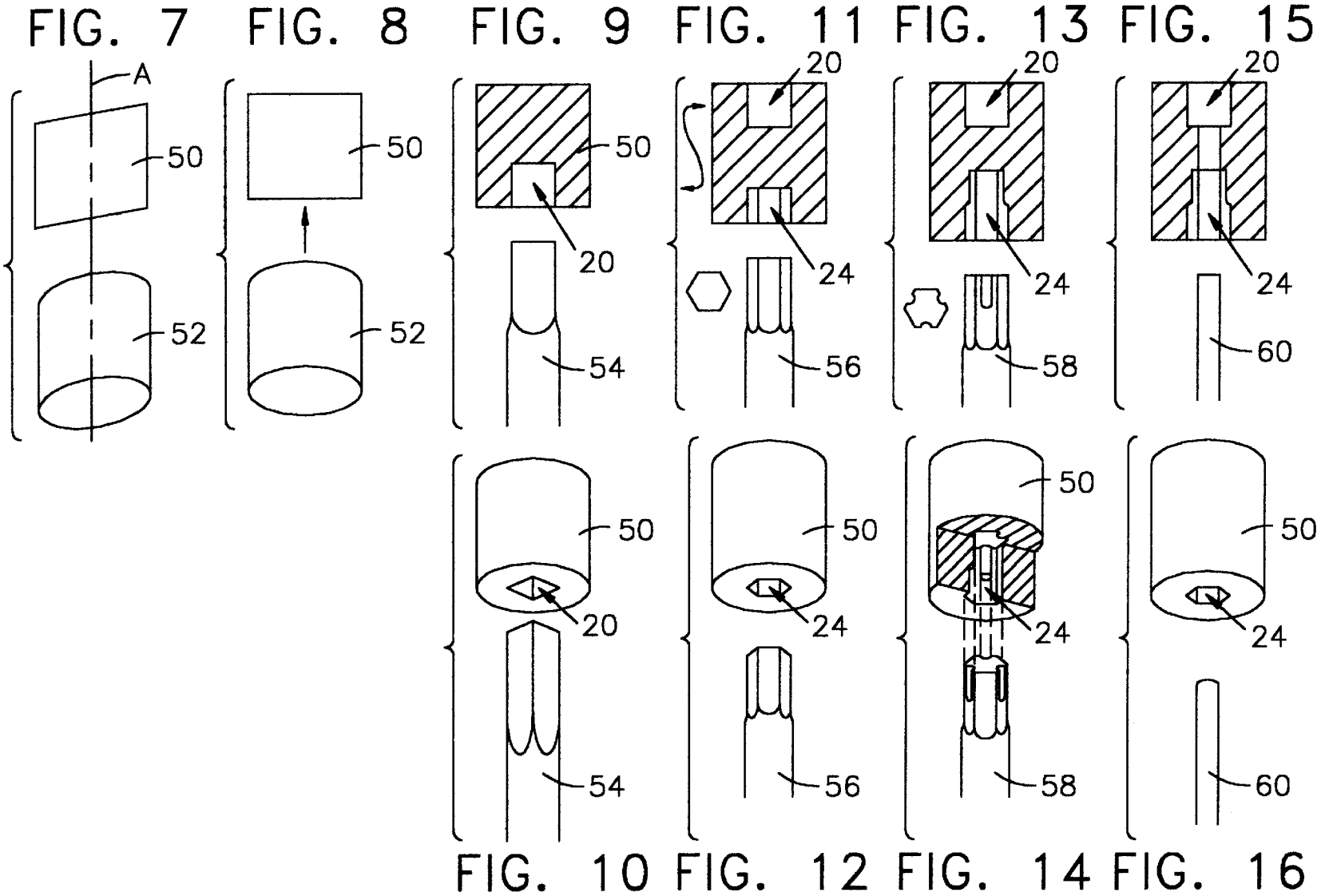
FIGS. 7–16 illustrate the sequential steps of the process for manufacturing a socket driver in accordance with the present invention.

Turning to FIGS. 7–14, successive steps of the method or process of forming the socket driver in accordance with the present invention. In FIG. 7, a cylindrical section of a rod is illustrated in which the end circular surfaces are not perpendicular to the axis A of the rod. Any suitable tool, such as a press 52 may be used to re-arrange the end surfaces so that they are perpendicular to the axis A, as suggested in FIG. 8.

All of the features of the socket driver 10 in accordance with the present invention are preferably formed with broaching tools, although other procedures may be used with different degrees of advantage. In FIGS. 9 and 10, the section of rod in FIG. 8 is shown to be formed with the rectangular cavity 20 by using a rectangular broaching tool 54. After the cavity 20 has been formed, the rod 50 is reversed 180° as suggested in FIGS. 11 and 12 and a hexagonal broaching tool is used to form the hexagonal cavity 24 with the broaching tool 56. The protuberances are then formed by using a further specialized broaching tool 58 with a broaching tip which is generally triangular in cross section with grooves being formed at the edges or points where the apices of the triangle would be normally located. The broaching tip of the broaching tool 58 has dimensions selected so as to remove some additional material from the wall formed by the broaching tool 56 but at the same time, retain, due to the groove or channels, the protuberances which have been described. Finally, in FIGS. 15 and 16, a final broaching tool in the form of a cylindrical rod is used to form the through opening or hole 36.

As will be noted, therefore, all of the features of the socket driver 10 are formed by using broaching tools in successive steps. As indicated, however, any other means for providing protuberances of the type aforementioned within a conventional socket driver may be used for purposes of the present invention.

Numerous alterations of the above structures herein discussed will suggest themselves to those skilled in the prior art, however, it is to be understand that the present disclosure relates to preferred embodiments of the invention which are for purposes of illustration only and are not to be construed as limitation of the invention.

We claim:

1. A socket driver comprising a socket body having a generally circular cylindrical wall defining an axis and having opposing axial ends; coupling means provided at one axial end for coupling said socket body to a mechanically driven shaft during use, the other axial end of said socket body having a generally cylindrical cavity co-axially aligned with said socket body axis and defining an interior surface of said cylindrical wall, said interior surface being formed of a plurality of pairs of opposing flat substantially parallel surfaces together forming a receiving space of substantially uniform predetermined polygonal cross-section, said substantially cylindrical cavity being dimensioned to receive a shank of a driver bit, having a polygonal cross-section corresponding to said predetermined polygonal cross-section, with clearance fit; retaining protuberance means provided on only one of each pair of said opposing flat surfaces projecting into said cavity to establish an interference fit between the driver bit shank and each protuberance means on one flat surface of each pair of surfaces and the associated opposing flat surface of each said pair when the driver bit shank is inserted into said cavity, said cylindrical wall and protuberance means having dimensions and being formed of a material to provide, upon forceful insertion of a bit driver shank, sufficient outward deflection of at least one surface of at least one pair of said surfaces to create internal restoring forces sufficient to maintain a degree of retention on the driver bit with said socket body.

2. A socket driver as defined in claim 1, wherein said predetermined polygonal cross-section is hexagonal.

3. A socket driver as defined in claim 1, wherein said cylindrical cavity has a predetermined axial length, and said retaining protuberance means extend along a portion of said predetermined axial length.

4. A socket driver as defined in claim 3, wherein said retaining protuberance means extend along approximately one half of said predetermined axial length.

5. A socket driver as defined in claim 1, wherein said cylindrical cavity has an open end for receiving a bit driver and an interior end, said retaining protuberance means extending substantially from said interior end and a point intermediate said open and interior ends.

6. A socket driver as defined in claim 5, wherein said intermediate point is substantially midway between said open and interior ends.

7. A socket driver as defined in claim 1, wherein said retaining protuberance means comprises a plurality of elongate projections each of which is substantially parallel to said axis.

8. A socket driver as defined in claim 7, wherein said cylindrical cavity has an open end for receiving a bit driver and an interior end, each elongate projection being provided with a tapered surface at the axial end of the projection most proximate to said open end, said tapered surfaces acting as inclined wedges for facilitating insertion of a bit driver into said cylindrical cavity.

9. A socket driver as defined in claim 1, wherein said coupling means comprises a generally rectangular cavity co-axial with said socket body axis for receiving a rectangular driver shank.

10. A socket driver as defined in claim 9, wherein an opening is provided between said cylindrical and rectangular cavities, whereby a bit driver secured within said cylindrical cavity by interference fit may be removed by impact forces applied to the bit driver by means of a suitable tool applied to the bit driver through said rectangular cavity and said opening.

* * * * *